United States Patent [19]

Taguchi

[11] 4,301,329

[45] Nov. 17, 1981

[54] SPEECH ANALYSIS AND SYNTHESIS APPARATUS

[75] Inventor: Tetsu Taguchi, Tokyo, Japan

[73] Assignee: Nippon Electric Co., Ltd., Tokyo, Japan

[21] Appl. No.: 942

[22] Filed: Jan. 4, 1979

[30] Foreign Application Priority Data

Jan. 9, 1978 [JP] Japan ..... 53-1282
Jan. 9, 1978 [JP] Japan ..... 53-1283
Nov. 10, 1978 [JP] Japan ..... 53-138690

[51] Int. Cl.[3] ..... G10L 1/00
[52] U.S. Cl. ..... 179/1 SA
[58] Field of Search ..... 179/1 SA, 1 SD

[56] References Cited

U.S. PATENT DOCUMENTS 3,715,512 2/1973 Kelly ..... 179/1 SA
4,038,495 7/1977 White ..... 179/1 SA

*Primary Examiner*—Mark E. Nusbaum
*Assistant Examiner*—E. S. Kemeny
*Attorney, Agent, or Firm*—Sughrue, Mion, Zinn, Macpeak & Seas

[57] ABSTRACT

In order to prevent errors and instability which may occur in a speech analysis and synthesis apparatus when the normalized predictive residual power falls to low levels, for example in high-pitched speech, the calculation of linear predictor coefficients from the autocorrelation coefficients of the speech sound is stopped when the normalized predictive residual power falls below a predetermined threshhold level. Either a variable stage synthesis filter is used having its number of stages determined by the number of linear predictor coefficients actually calculated, or a fixed number of stages can be used and a zero value filter stage coefficient supplied to those stages in excess of the number of coefficients calculated. Degradation of speech quality due to quantization and transmission errors can be alleviated by computing the normalized predictive residual power on the synthesis side from the transmitted predictor coefficients and using it to excite the input to the synthesis filter. In one embodiment especially suitable for high ambient noise conditions, both a sound source and a noise source are employed and two different conversion and window processing channels are provided; one for noise-affected speech and the other for pure noise. Autocorrelations in each channel are performed along with correllations between channels, and the autocorrelations and correllations are then appropriately combined to provide an autocorrelation coefficient of the speech sound.

10 Claims, 7 Drawing Figures

FIG 2
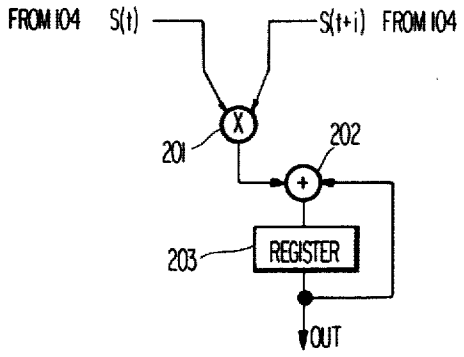
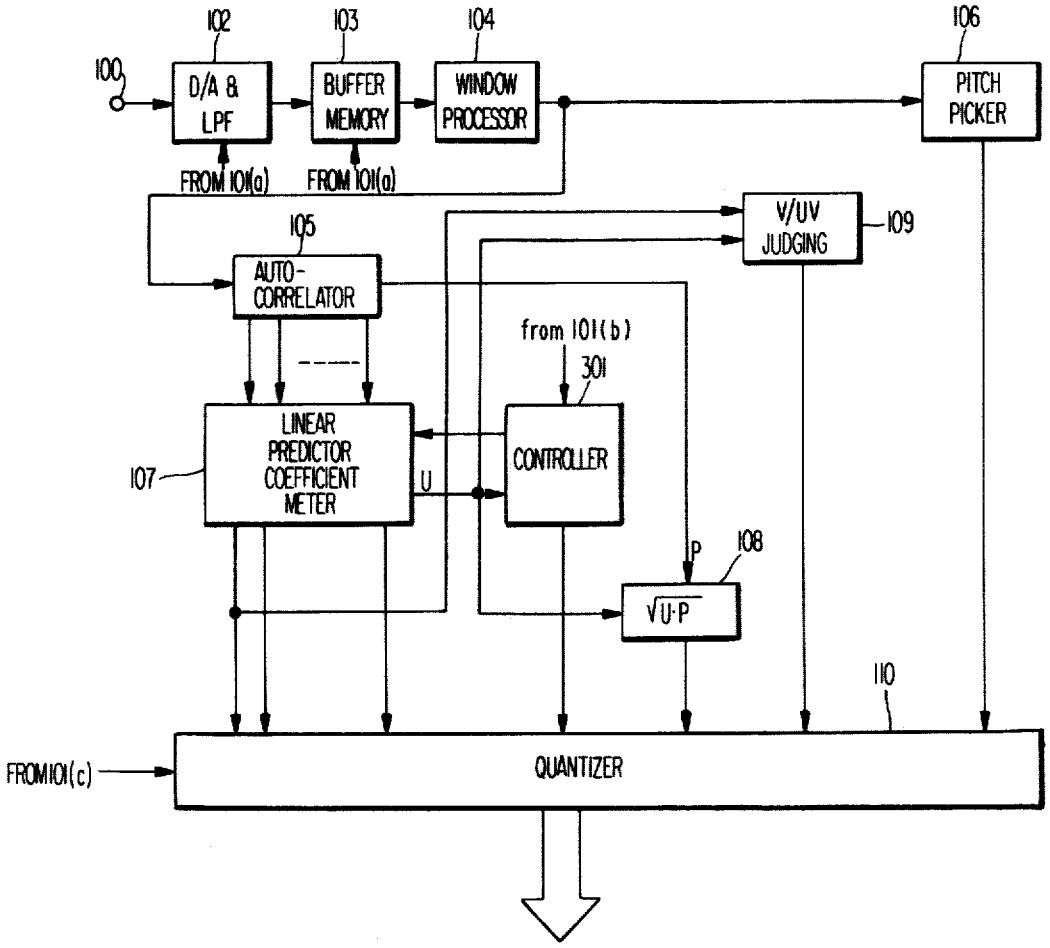
FIG 3

SPEECH ANALYSIS AND SYNTHESIS APPARATUS

BACKGROUND OF THE INVENTION

The present invention relates to a speech analysis and synthesis apparatus and, more particularly, to an apparatus of this type having a digital filter of improved stability for speech synthesis and having minimized deterioration of speech quality and minimized reduction in transmission information arising from transmission error and quantizing error.

Further reduction in the frequency band used in the encoding of voice signals has been increasingly demanded as a result of the gradually increasing practice of the composite transmission of the speech-facsimile signal combination or the speech-telex signal combination or the use of multiplexed speech signals for the purpose of more effective use of telephone circuits.

In the band reduction encoding, the speech sound is expressed in terms of two characteristic parameters, one for speech sound source information and the other for the transfer function of the vocal tract. In the speech analysis and synthesis technique, the speech waves voiced by a human are assumed to be radiation output signals radiated through the vocal tract which is excited by the vocal cords to function as a speech sound source, and the spectral distribution information equivalent to the speech sound source information and the transfer function information of the vocal tract is sampled and encoded on the speech analyzer side for transfer to the synthesizer side. Upon receipt of the coded information, the synthesizer side uses the spectral distribution information to determine the coefficient of a digital filter for speech synthesis and applies the speech source information to the digital filter to reproduce the original speech signal.

Generally, the spectral distribution information is expressed by the spectral envelope representative of spectral distribution and the resonance characteristic of the vocal tract. As is well known, the speech sound information is the residual signal resulting from the subtraction of the spectral envelope component from the speech sound spectrum. The residual signal has a spectral distribution over the entire frequency range of the speech sound, and has a complex waveform to represent the residual signal in terms of digitized information is not consistent with the aim of band reduction encoding. In general, however, a voiced sound produced by vibration of the vocal cords is represented by a train of impulses which has an envelope shape analogous to the waveform of the voiced sound and the same pitch as that of the voiced sound while, unvoiced sound produced by air passing turbulently through constrictions in the tract is expressed by the white noise. Therefore, the band reduction of the speech sound information is usually carried out by using the impulse train and the white noise for representing the voiced and unvoiced sounds.

As described above, the spectral envelope is used to express the spectral distribution information and to distinguish between the voiced and unvoiced sounds, while pitch period and sound intensity are employed for the speech sound source information. A spectral variation of the speech wave is relatively slow because the speech signal is produced through motions of the sound adjusting organs such as tongue and lips. Accordingly, a spectral variation for a 20 to 30 msec period can be held constant. For analysis and synthesis purposes, therefore, every 20 msec portion of the speech signal is handled as an analysis segment or frame, which serves as a unit for the extraction of the parameters to be transferred to the synthesis side. On the synthesis side, the parameters transferred from the analysis side are used to control the coefficients of a synthesizing filter and as the exciting input on the analysis frame-by-analysis frame basis, for the reproduction of the original speech.

To extract the above-mentioned, parameters, the so-called linear prediction method is generally used (For details, reference is made to an article titled "Linear Prediction: A Tutorial Review" by JOHN MAKHOUL, PROCEEDINGS OF THE IEEE, VOL. 63, No. 4, APRIL 1975). The linear prediction method is based on the fact that a speech waveform is predictable from linear combinations of immediately preceding waveforms. Therefore, when applied to the speech sound analysis, the speech wave data sampled is generally given as $$S(n) = \sum_{i=1}^{P} \alpha_i \cdot S(n-i) + U_i = S(n) + U_n \quad (1)$$

where S(n) is the sample value of the speech voice at a given time point; S(n-i), the sample value at the time point i samples prior thereto; P, the linear predictor; Sn, the predicted value of the sample at the given time point, Un is the predicted residual difference; and $\alpha_i$, the predictor coefficient. The linear predictor coefficient $\alpha_i$ has a predetermined relation with the correlation coefficients taken from the samples. It is therefore obtainable recursively from the extraction of the correlation coefficients, which are then subjected to the so-called Durbin method (Reference is made to the above-cited article by JOHN MAKHOUL). The linear predictor coefficient $\alpha_i$ thus obtained indicates the spectrogram envelope information and is used as the coefficient for the digital filter on the synthesis side.

As the parameter representing the spectral envelope of the speech sound, the variation in the cross sectional area of the vocal tract with respect to the distance from the larynx is often employed, the variation meaning the reflection coefficient of the vocal tract and being called the partial autocorrelation coefficient, PARCOR coefficient or K parameter hereunder. The K parameter determines the coefficient of a filter for synthesizing the speech sound. When $|K| > 1$, the filter is unstable, as is known, so that the stability of the filter can be checked by using the K parameter. Thus, the K parameter is of importance. Additionally, the K parameter is coincident with a K parameter appearing as an interim parameter in the course of the computation by the above-mentioned recursive method and is expressed as a function of a normalized predictive residual power (see the above-mentioned article by J. MAKHOUL). The normalized predictive residual power is defined as a value resulting from dividing u in the equation (1) by the power of the speech sound in the analysis frame.

The exposition of the speech analysis and synthesis is discussed in more detail in an article "Speech Analysis and Synthesis by Linear Prediction of the Speech Wave " by B. S. ATAL AND SUZANNE L. HANAVER, The Journal of the Acoustic Society of America. Vol. 50, Number 2 (Part 2), 1971, pp. 637 to 655.

The conventional speech analysis and synthesis apparatus of this kind has a very limited computational speed due to the limitation on the scale of the apparatus allowed therefor. The arithmetic unit of a limited accuracy arithmetic such as one based on a limited word length with fixed decimal point is usually employed for such apparatus. The normalized predictive residual power is relatively small in the voiced sound with high periodicity but relatively large in the unvoiced sound with low periodicity, and its value is lower as the analyzing order is higher (see the article by ATAL et al, FIG. 5 on page 642, for example).

The conventional speech analysis and synthesis apparatus has a synthesis filter of a fixed number of stages corresponding to the number of order for the linear predictor coefficient. Therefore, when a waveform of extremely high periodicity, i.e., of clear spectrogram structure, such as the stationary part of a voiced sound, is processed, the normalized predictive residual power tends to be smaller than the smallest significant value that can be handled by the above-mentioned limited accuracy arithmetic. More definitely, this means that the K parameters, which are given as a function of the normalized predictive residual power, tend to be $|K|>1$, adversely affecting the stability of the synthesis filter. The window processing applied to successive prefixed lengths of sound waveform may help increase the normalized predictive residual power, because the window length rarely equals an integral multiple of the pitch period of the sound even if it is of high periodicity and, consequently because the spectral structure of the sound waveform within a single window length has a lower clarity. Such increased normalized predictive residual power may help avoid the above-mentioned instability of the synthesis filter. However, the use of the window processing does not necessarily mean an increase in the predictive residual power sufficient to contribute to the stability of the synthesis filter, because a high-pitched voice sound, such as a female voice, has a sufficient periodicity within a very short window length to lower the predictive residual power.

When the linear predictor coefficient for the analysis is made to be of high order while the number of stages of the synthesizing digital filter is reduced to overcome such difficulty, the approximation of the spectral envelope of a less stationary speech sound or of the voiced sound having a relatively large predictive residual compared power with the arithmetic accuracy is considerably reduced, deteriorating the quality of the synthesized speed sound.

The calculation of the linear predictor coefficient under a high ambient noise involves errors since the signal wave to be analysed is the superposition of the ambient noise on the speech wave. The spectral envelope calculated from the linear predictor coefficient affected by the ambient noise is different from the spectral envelope of the original speech wave. Under the influence of the ambient noise, the linear predictor coefficient must be analyzed to remove the influence by the ambient noise. Such analysis is usually carried out by using an autocorrelation coefficient as follows. The autocorrelation coefficient $\rho(SN)(SN)\tau$ of a noise-affected speech sound at a delay $\tau$ is given as $$\rho(SN)(SN)\tau = \sum_{i=0}^{N-1} (Si + Ni)(Si + \tau + Ni + \tau)$$

where $S_0, S_1, S_2, \ldots$ are a series of samples of a speech sound wave; $n_0, n_1, n_2, \ldots$, a series of samples of a noise wave; $S_0+N_0, S_1+N_1, S_2+N_2, \ldots$, a series of samples of a noise-affected speech sound; N, the number of samples of a waveform to be analyzed; and i, the number of each sample. The right side of the above equation is rewritten in the form of the autocorrelation:

$$\rho(SN)(SN)\tau = \rho(S)(S)\tau - \rho(N)(N)\tau + \rho(N)(SN)\tau$$

where $$\rho(S)(S)\tau = \sum_{i=0}^{N-1} Si \cdot Si + \tau$$

$$\rho(N)(N)\tau = \sum_{i=0}^{N-1} Ni \cdot Ni + \tau$$

$$\rho(SN)(N)\tau = \sum_{i=0}^{N-1} (Si + Ni) \cdot Ni + \tau$$

$$\rho(N)(SN)\tau = \sum_{i=0}^{N-1} Ni \cdot (Si + \tau + Ni + \tau)$$

Generalizing the delay $\tau$, $\rho_{(SN)(SN)\tau}$ is defined as the first autocorrelation coefficient and $(\rho_{(SN)(N)\tau} - \rho_{(N)(N)\tau} + \rho_{(N)(SN)\tau})$ is defined as the second autocorrelation coefficient. Under this definition, the autocorrelation of a speech sound is expressed as a difference between the first and second autocorrelation coefficients.

As described above, to obtain the parameter to correctly express only the feature of the speed sound under high ambient noise, the autocorrelation of the speech sound is expressed in terms of the difference between the first and second autocorrelation coefficients. More specifically, a conventional method employs an acoustic-to-electrical signal converting unit for noise detection as well as an acoustic-to-electrical signal converting unit for speech signal detection. With these units, the acoustic signal from a noise source and the acoustic signal from a speaker are detected as a synthesis acoustic signal while at the same time only the acoustic signal derived from the noise source is detected. Then, the autocorrelation coefficient of the noise-affected speech sound and the autocorrelation coefficient of the noise are measured. Following this, the correlation coefficient between the noise-affected speech signal is measured from the above two kinds of signals. Similarly, the correlation coefficient between the noise and the noise-affected speech signal is measured. Then, the autocorrelation coefficient of the speech sound signal is measured on the basis of the two autocorrelation coefficients, and the linear-predictor coefficient is measured on the basis of the autocorrelation coefficient of the speech signal. In the conventional method, however, when the spatial distances from the noise source to the acoustic to electrical signal converters for signal detection and noise detection are different from each other, no linearity or analogy exists between the input speech signals to both converting units. Therefore, the relation established may be inaccurate among the autocorrelation coefficient of the speech signal relative to the autocorrelation coefficient of the noise-affected speech signal, the autocorrelation coefficient of the noise, the correlation coefficient between the noise-affected speech signal and the noise, and the correlation coefficient between the noise and the noise-affected speech signal.

As a result, there is a possibility that the autocorrelation coefficient measured of the speech sound at delay $\tau$ becomes larger than that of the sound per se. Specifically, when the autocorrelation value at delay $\tau$ is normalized to "1", the autocorrelation value of the speech sound measured at delay $\tau$ may be closer to "1", compared to that of the speech sound per se, and, as the case may be, it exceeds "1". When the autocorrelation value exceeds "1", the synthesizing filter with the coefficient which is the linear predictor coefficient calculated from the autocorrelation coefficient becomes unstable. This is seen, for example, from the fact that when the linear predictor coefficient is of first degree, the K parameter which is the interim parameter in the calculation of the linear predictor coefficient by the Durbin method exceeds "1".

The above-mentioned conventional method to obtain the linear predictor coefficient for the purpose of expressing correctly only the feature of the speech sound under the condition of high ambient noise, has a disadvantage that the speech synthesis filter with the obtained linear predictor coefficient as its coefficient becomes unstable because of the influence of noise. As described above, the conventional method first measures the autocorrelation coefficient of the speech sound on the basis of the autocorrelation coefficient of the noise-affected speech sound, the autocorrelation of noise, the correlation coefficient between the noise-affected speech sound and noise, and the correlation coefficient between noise and the noise-affected speech sound, and then obtains the linear predictor coefficient depending on the autocorrelation coefficient measured of the speech sound.

Evidently, the conventional method suffers from the same disadvantage when the noise source has a spatially large volume, or when the transfer function in the acoustic area ranging from the noise source to the converter for speech sound detection is different from that in the acoustic area from the noise source to the converter for noise detection. In the characteristic parameters of the speech sound obtained on the analysis side, the speech sound source information, particularly the normalized predictive residual power representative of the amplitude information or the complex parameter of a short time average power and a normalized predictive residual power, have a much larger rate of time variation than that of the linear predictor coefficient $\alpha$ or the K parameter. This arises from the fact that, while K parameter representative of the reflection coefficient of the vocal tract depends on the cross sectional area of the vocal tract changing with muscular motion of a human and therefore slowly varies with time, the normalized predictive residual power U as expressed by $$Up=(1-Ki^2) \quad (2)$$

where Ki is the K parameter of i-th order and p is the number of order, is affected by the amplification of all the changes of the respective Ki's and therefore its variation is complicated and steep.

For this reason, in the analysis of the parameter including the normalized predictive residual power, the analysis frame length must be set shorter than that of the analysis frame required for analyzing the other parameters such as the linear predictor coefficient and the like, resulting in the increase of transmission capacity.

Since the time variation of the parameters including the normalized predictive residual power is signficant, the parameters are easily influenced by transmission error due to external and internal causes in the course of the transmission. Further, when the parameters are quantized they involve quantization error. When the normalized predictive residual power influenced by such errors is applied as the amplitude information of the original speech sound to the synthesizing filter, the reproducibility of the amplitude is, of course, poor. Specifically, in the conventional apparatus, the linear predictor coefficient is exactly coincident with the normalized predictive residual power representative of the spectral envelope of the speech sound on the analysis side, while, on the synthesis side, the normalized predictive residual power is largely influenced by the above errors but the linear predictor coefficient is little effected by errors. Therefore, the speech sound synthesized by using both the factors is poor in amplitude reproducibility.

SUMMARY OF THE INVENTION

Accordingly, an object of the invention is to provide a speech analysis and synthesis apparatus capable of making speech analysis and synthesis with high stability even when the nomalized predictor residual power is below the limited accuracy of the apparatus as in the stationary part of voiced sound stationary part.

Another object of the invention is to provide a speech analysis and synthesis apparatus which is stably operable even under high ambient noise.

Still another object of the invention is to provide a speech analysis and synthesis apparatus which can compensate for deterioration of the amplitude reproducibility due to quantization error and transmission error and is capable of making speech analysis and synthesis with high stability even when the amount of information to be transmitted is little.

According to the invention, the normalized residual power obtained on the analysis side is monitored and when it falls below a predetermined value, the synthesis filter is controlled to be the number of stages corresponding to the orderin such a case or the linear predictor coefficient with higher order than that is transmitted with zero to thereby eliminate the instability of the synthesis filter. Further, the normalized residual power is obtained from the linear predictor coefficient on the synthesis side and is used to excite the synthesis filter to thereby prevent speech quality from being degraded due to quantization error and transmission error.

In one embodiment especially suitable for high ambient noise conditions, both a sound source and a noise source are employed and two different conversion and window processing channels are provided; one for noise-affected speech and the other for pure noise. Autocorrelations in each channel are performed along with correllations between channels, and the autocorrelations and correllations are then appropriately combined to provide an autocorrelation coefficient of the speech sound.

Other objects and features of the invention will be apparent from the following description taken in conjunction with the accompanying drawings, in which:

BRIEF DESCRIPTION OF THE DRAWINGS

FIG. 2 shows a block diagram of a part of the circuit shown in FIG. 1;

FIG. 3 shows a block diagram of the analysis side of a speech analysis and synthesis apparatus according to the invention;

DESCRIPTION OF THE PREFERRED EMBODIMENTS

Figure 1:
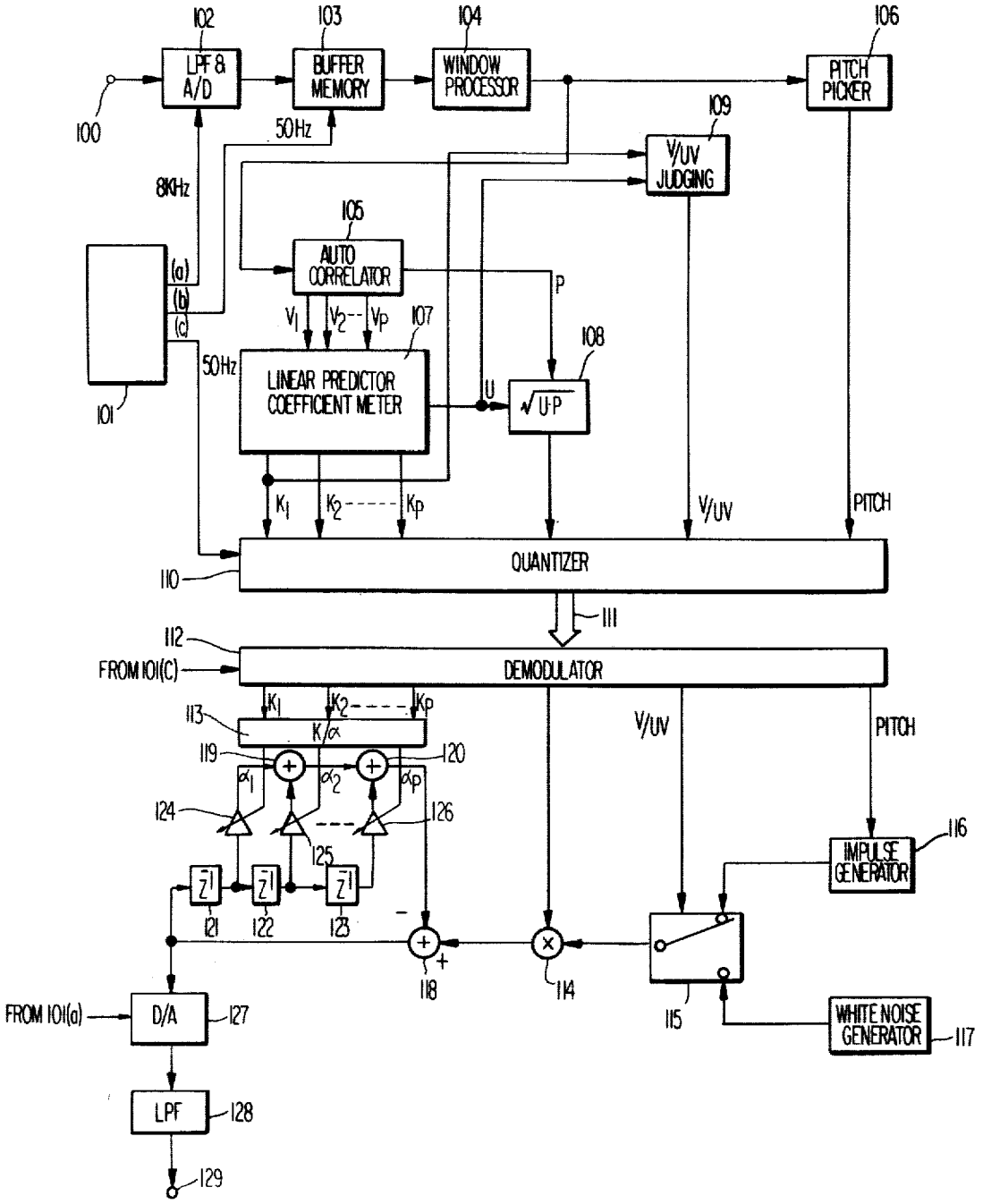
FIG 1 PRIOR ART
FIG. 1 shows a block diagram of an ordinary speech analysis and synthesis apparatus.

Reference is first made to FIG. 1 illustrating an ordinary speech analysis and synthesis apparatus. In operation, a speech sound signal is applied through a waveform input terminal 100 to an analog to digital (A-D) converter 102. In the A-D converter 102, a high frequency component of the speech sound signal is filtered out by a low-pass filter with a cut-off frequency of 3,400 Hz and the speech signal filtered out is sampled by sampling pulses of 8,000 Hz derived from terminal (a) of timing source 101. The sampled signal is then converted into a digital signal with 12 bits per one sample for storage in a buffer memory 103. The buffer memory 103 temporarily stores the digitized speech wave for approximately one analysis frame period (for example, 20 msec) and supplies the speech wave stored for every one analysis frame period to a window processing memory 104, in response to the signal from the output terminal (b) of the timing source 101. The window processing memory 104 includes a memory capable of storing the speech wave of one analysis window length, for example, 30 msec, and stores the speech wave of the total of 30 msec; 10 msec of the speech wave transferred from the buffer memory 103 in the preceding frame, the 10 msec part being adjacent to the present frame, and the whole speech wave in the present frame transferred from the buffer memory 103. The window processing memory 104 then multiplies the speech wave stored by a window such as the Hamming window and then applies the multiplied speech wave to an autocorrelator 105 and a pitch picker 106.

The autocorrelator 105 calculates an autocorrelation coefficient in delay $\tau$ from a delay 1, for example, 125 $\mu$sec to a delay p, for example, 1250 $\mu$sec (P=10), by using a speech wave representative of word code in accordance with the following equation (3):

$$p_\tau = \frac{\sum_{i=0}^{N-1-\tau} Si \cdot Si + \tau}{\sum_{i=0}^{N-1} Si^2} \quad (3)$$

Further, the autocorrelator 105 supplies to an amplitude signal instrument 108 the energy of the speech wave code word within one window length, that is, short time average power $$\sum_{i=0}^{N-1} Si^2.$$

A linear predictor coefficient instrument 107 measures K parameter of p and the normalized predictive residual power U from the autocorrelation coefficient supplied from the autocorrelator 105 by the method known as an autocorrelating method and distributes the K parameters measured to a quantitizer 110 and the normalized predictive residual power U to an amplitude signal meter 108.

The amplitude signal meter 108 measures an exciting amplitude as $\sqrt{U.P}$ from the short time average power P supplied from the autocorrelator 105 and the normalized predictive residual power U supplied from the linear predictor coefficient meter 107 and supplies the measured exciting amplitude to the quantitizer 110.

The pitch picker 106 measures the pitch period from the speech voiced wave representing word code supplied from the window processing memory 104 by a known autocorrelation method, or the Cepstrum method, as described in an article "Automatic Speaker Recognition Based on Pitch Contours" by B. S. Atal, Ph D thesis Polytech. Brooklyn (1968) and in an article "Cepstrum Pitch Determination" by A. M. Noll, J. Acoust. Soc. Amer., Vol. 41, pp. 293 to 309, Feb. 1967. The result of the measurement is applied as the pitch period information to the quantitizer 110.

A voiced/unvoiced judging unit 109 judges voiced or unvoiced signal by a well known method using parameters such as K parameters measured by the linear predictor coefficient meter 107, and the normalized predictive residual power. This method is discussed in detail in an article "A Pattern Recognition Approach to Voice-Unvoiced-Silence Classification with Application to Speech Recognition", IEEE TRANSACTION ON ACOUSTIC, SPEECH, AND SIGNAL PROCESSING, VOL. ASSP-24, No. 3, June 1976.

The quantitizer 110 quantitizes K parameters K1, K2 . . . Kp supplied from the linear predictor coefficient measuring unit 107, the exciting amplitude information $\sqrt{U.P}$ fed from the amplitude signal meter 108, the judging information supplied from the voice/unvoiced judging unit 109, and the pitch period information fed from the pitch picker 106, into 71 bits. With one bit derived from the output terminal (c) of the timing source 101 added to the 71 bit code for the transmission frame synchronization, the quantization output is transmitted in the form of 72 bit transmission frames through a transmission line 111.

The transmission line 111 is capable of transmitting data of 3600 bits/sec, for example, and leads the data of each 72 bit frame and 20 msec frame period, i.e., of 3600 Baud, to a demodulator 112.

The demodulator 112 detects the frame synchronizing bit of the data fed through the transmission line 111, and delivers demodulated K parameters to a K/$\alpha$ converter 113, the exciting amplitude information to a multiplier 114, the voiced/unvoiced decision information to a switch 115, the pitch period information to an impulse generator 116.

The impulse generator 116 generates a train of impulses with the same period as the pitch period obtained from the pitch period information and supplies it to one of the fixed contacts of the switch 115. A noise generator 117 generates white noise for transfer to the other fixed contact of the switch 115. The switch 115 couples the impulse generator through the movable contact with the multipler 114, when the voiced/unvoiced judging information indicates the voiced sound. On the other hand, when the judging information indicates the unvoiced sound, the switch 115 couples the noise generator 117 with the multiplier 114.

The multiplier 114 multiplies the impulse train or the white noise passed through the switch 115 by the exciting amplitude information, i.e., the amplitude coefficient, and sends the multiplied signal to an adder 118. The adder 118 provides a summation of the output signal from the multiplier 114 and the signal delivered from an adder 120 and delivers the sum to a one-sample-period delay 121 and a digital-to analog (D-A)converter 127. The delay 121 delays the input signal by one sampling period of the A-D converter 102 and sends the output signal to the multiplier 124 and to a one-sample-period delay 122. Similarly, the output signal of the one-sample-period delay 122 is applied to a multiplier 125 and the next stage one-sample-period delay. In a similar manner, the output of the adder 118 is successively delayed finally through one-sample-period delay 123 and then is applied to a multiplier 126.

The multiplier factors of the multipliers 124, 125 and 126 are determined by $\alpha$ parameters supplied from K/$\alpha$ converter 113. The result of the multiplication of each multiplier is successively added in adders 119 and 120. The K/$\alpha$ converter 113 converts K parameters to linear predictor coefficients $\alpha_1, \alpha_2, \alpha_3, \ldots \alpha_p$ by the recursive method mentioned above, and delivers $\alpha_1$ to the multiplier 124, $\alpha_2$ to the multiplier 125, . . . and $\alpha_p$ to the multiplier 126.

The adders 118 to 120, the one-sample delays 121 to 123, and the multipliers 124 to 126 cooperate to form a speech sound synthesizing filter. The synthesized speech sound is converted into analog form by the D-A converter 127 and then is passed through a low-pass filter 128 of 3400 Hz so that the synthesized speech sound is obtained at the speech sound output terminal 129.

In the circuit thus far described, the speech analysis part from the speech sound input terminal 100 to the quantitizing circuit 110 may be disposed at the transmitting side, the transmission line 111 may be constructed by an ordinary telephone line, and the speech synthesis part from the demodulator 112 to the output terminal 129 may be disposed at the receiving side.

The autocorrelation measuring unit shown in FIG. 1 may be of the product-summation type shown in FIG. 2. With S(0), S(1), . . . S(N-1) for the speech wave code words which are input signals to the window processing memory (in the designation, N designates the number of sampling pulses within one window length), wave data S(t) corresponding to one sampling pulse and another wave data S(t+2) spaced by i sample periods from the wave data S(t) are applied to a multiplier 201 of which the output signal is applied to an adder 202. The output signal from the adder 202 is applied to a register 203 of which the output is coupled with the other input of the adder 202. Through the process in the instrument shown in FIG. 2, the numerator components of the autocorrelation coefficient $\rho_\tau$ shown in Eq. (3) are obtained as the output signal from the coefficient measuring unit 105 (the denominator component, i.e., the short time average power, corresponds to the output signal at delay 0). The autocorrelation coefficient $\rho_\tau$ is calculated by using these components in accordance with the equation (3).

Figure 4:
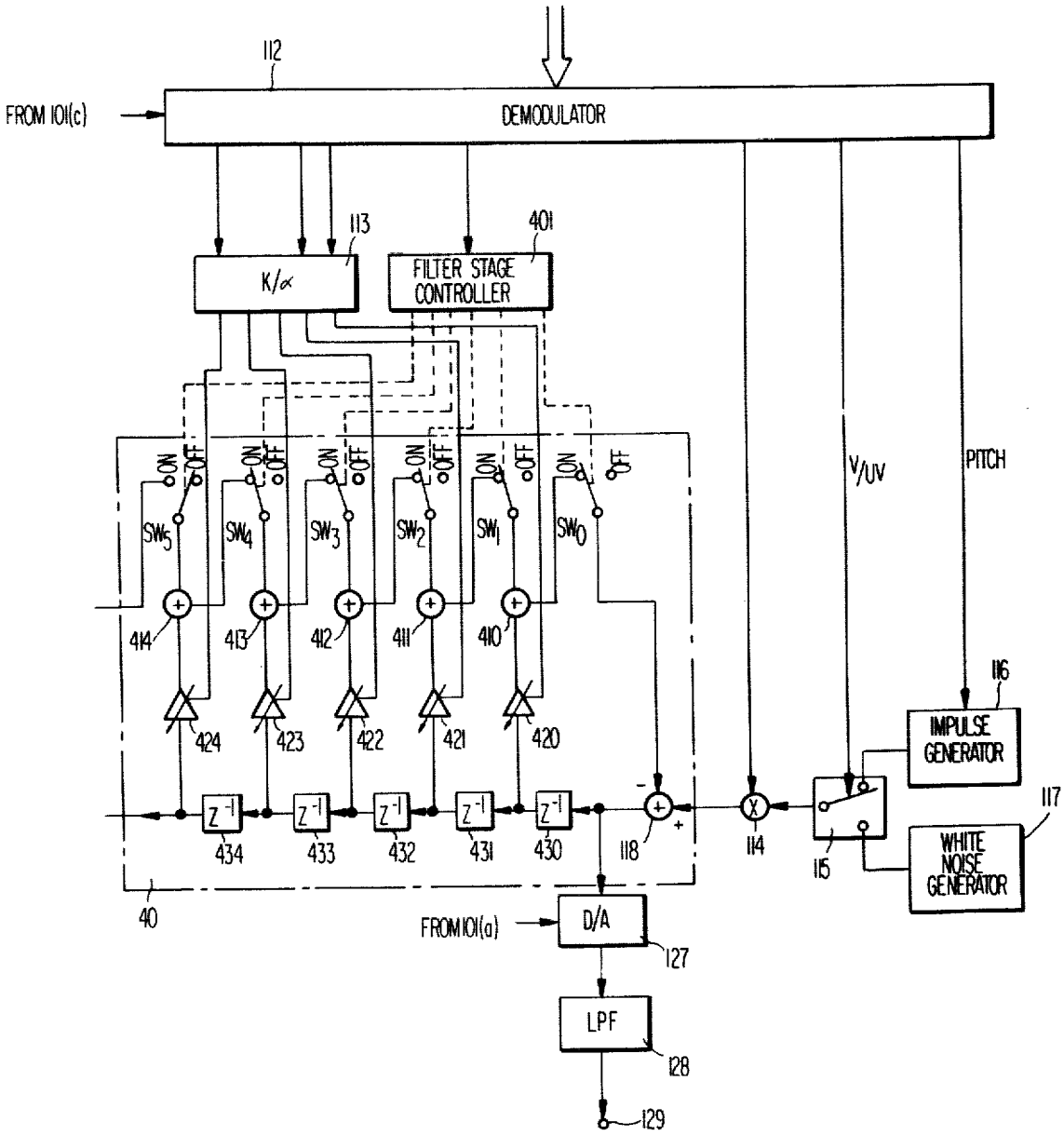
FIG. 4 shows a block diagram of the synthesis side of the speech analysis and synthesis apparatus according to the invention.

Turning now to FIGS. 3 and 4, there are shown block diagrams of the analysis side and the synthesis side in the apparatus of the invention. In these drawings, like reference numerals denote like parts or portions in FIG. 1. Linear predictor coefficient instrument 107 calculates the linear predictor coefficient of the first order and the normalized predictive residual power from the autocorrelation coefficient representing the reproducibility of a waveform delivered from the autocorrelator 105. The normalized predictive residual power is fed to a controller 301 and to an amplitude signal instrument 108. The controller 301 checks to determine whether the normalized predictive residual power is larger than a predetermined value or not, corresponding to the limited accuracy of the apparatus. When it is smaller than the predetermined value, a calculation stop signal is applied to linear predictor coefficient instrument 107. Upon receipt of the calculation stop signal, the linear predictor coefficient instrument 107 stops its calculation. When no calculation stop signal is applied thereto, it calculates the linear predictor coefficient of the second order and the normalized predictive residual power of the second order by using the autocorrelation coefficient representing the waveform reproducibility, the predictor coefficient of the first order, and the normalized predictive residual powder of the first order. Succeedingly, the instrument 107 recursively calculates the linear predictor coefficient until the controller 301 produces the calculation stop signal. Alternatively, the maximum predictor order N1 may be present to thereby stop the calculation of the coefficient measuring unit 107 automatically when it calculates the maximum one N1, regardless of the calculation stop signal, preventing the need for the increased order number for the linear predictor coefficient.

If the measuring unit 107 stops its calculation after calculating the linear predictor coefficient of the N2 order, the N2 order linear predictor coefficient is applied to a variable sage synthesis filter 40 in the synthesis side shown in FIG. 4. The controller 301 applies a variable filter control signal for controlling the number of the filter stages corresponding to the N2 order to the variable stage synthesis filter 40. The filter coefficient of the filter 40 is controlled by the linear predictor coefficient of the N2 order and the number of filter stages of the filter 40 is controlled by the variable stage filter control signal. Under such controls, the filter 40 is excited by an exciting signal and produces a synthesized speech sound signal to the D-A converter 127. As shown in FIG. 4, synthesis filter 40 is comprised of an adder 118, adders 410 to 414 of the same number as the filter stage number n previously set, multipliers 420 to 424, one-sample delays 430 to 434 and switches for controlling the number of filter stages. A control signal fed from the controller 301 on the analysis side is demodulated by a demodulator 112 on the synthesis side and is then sent to the filter stage controller 401. The controller 401, in response to the control signal, turns on switches SWo to SWn2 (in the drawing, SW4 is expressed SWn2) and turns off the remaining switches. With respect to the coefficient of the synthesis filter, the K parameter of the N2 order calculated on the synthesis side is converted into an $\alpha$ parameter by the K-$\alpha$ converter 113. The $\alpha$ parameter of the N2 order is applied to the corresponding multiplier 420 to 424. In the drawing, the $\alpha$ parameter corresponding to the N2 order is applied to the multiplier 423 for setting the filter coefficient. In place of the arrangement having the measuring unit 107 supplying the linear predictor coefficient of the N2 order and the controller 301 supplying the variable stage synthesis filter control signal to the synthesis filter, the linear predictor coefficient of the N3 order can be always transferred and the linear predictor coefficients from the (N2)+1 to the N3 order set to zero. In this alternative, the use of the fixed stage synthesis filter of n3 stages can attain approximately the same effect as that attained by the variable stage synthesis filter.

In the above-mentioned example according to the invention, when the normalized predictor residual power of the high order exceeds the accuracy range in the limited accuracy arithmetic because of high predictivity, as in the stationary part of voiced sound, the control 301 detects this to stop the calculation of the linear predictor coefficients of the superfluous order. The filter stage control signal is used corresponding to the order where the normalized predictive residual power is within the accuracy range of the apparatus. Further, the linear predictive coefficient of a higher order than that limiting order is treated as zero. For this, the speech sound may be stably synthesized at all times.

Figure 5:
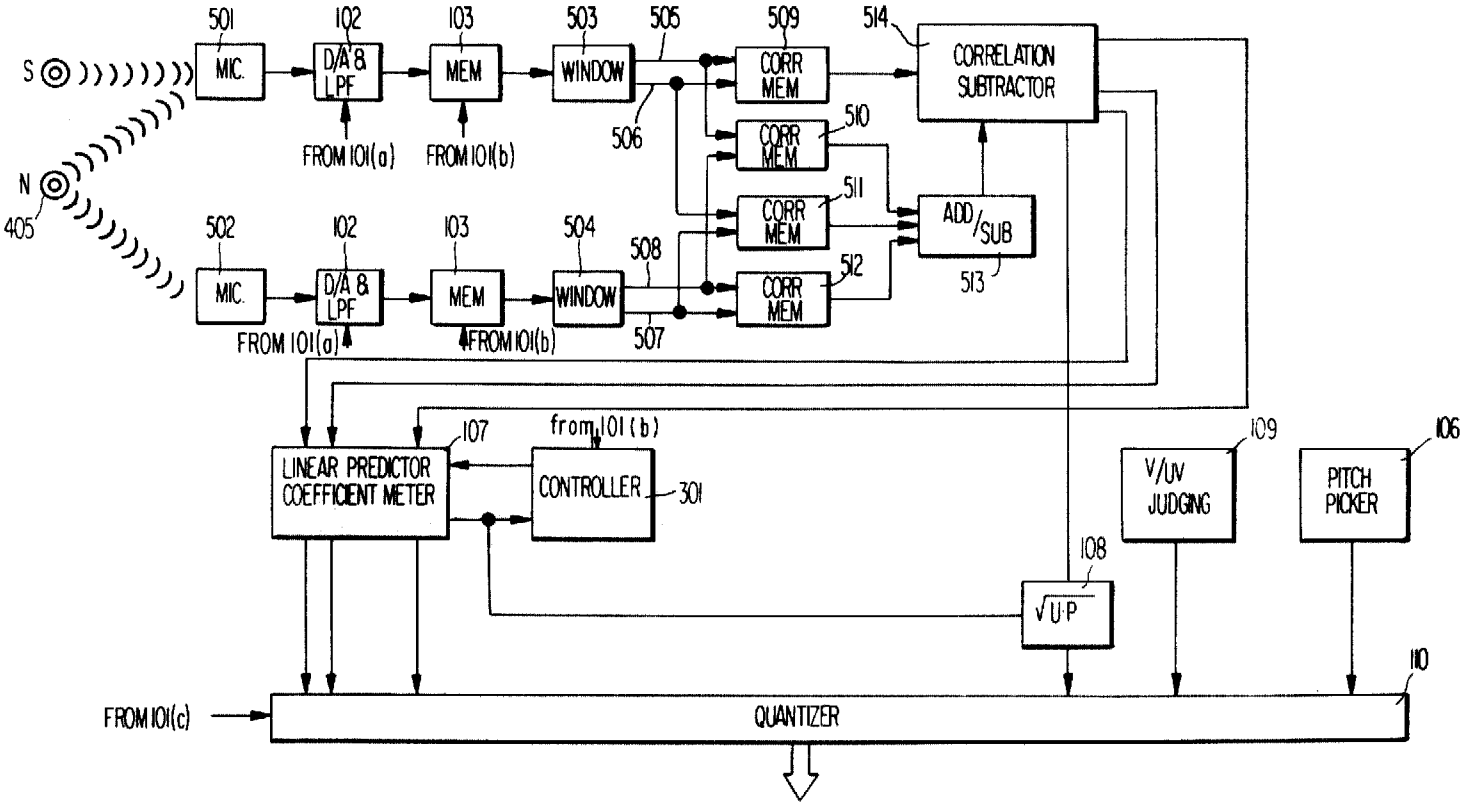
FIG. 5 shows a block diagram of the analysis side of the apparatus which is another embodiment according to the invention.

Turning now to FIG. 5, there is shown another embodiment of the sppech analysis and synthesis apparatus according to the invention which is operable stably even under high ambient noise. FIG. 5 illustrates in block form the construction of the analysis side as in FIG. 3. In the figure, like reference numerals denote like structural elements shown in FIG. 3. An acoustic signal generated by a noise source 405 is applied to an acoustic-to-electrical signal converter 501 and to another similar type converter 502, each of which may be a microphone. The converter 501 converts a signal mixed with acoustic signals generated by a speech sound and noise source N into an electrical signal an supplies the converted electrical signal to a window processing memory 503, through an A-D converter 102 and a buffer memory 103. The converter 502 converts the acoustic signal from the noise source into an electrical signal which in turn is applied to the window processing memory 503. The window processor 503 segments an electrical signal into windows such as rectangular windows or Hamming windows, and stores the segmented signals and produces the stored data at the fixed delay speech sound output terminal 505 and the variable delay speech sound output terminal 506. The window processing memory 504 segments an electrical signal derived from the converter 502 into windows such as rectangular windows or Hamming windows, stores the segmented signals therein and then produces them at the fixed delay noise output terminal 507 and the variable delay noise output terminal 508. Correlation instrumental memories 509 to 512 measure the correlation coefficients from delay 0 to T and store them therein.

The correlation instrumental memory 509 measures the autocorrelation coefficient of a noise-affected speech sound signal from delay 0 to T by using a noise-affected speech sound signal which is derived from the fixed delay speech sound output terminal and has no delay relative to the output signal derived from the variable delay speech sound output terminal 506, and by using a noise-affected speech sound signal which is derived from terminal 506 and has delays from 0 to T relative to the output signal from the output terminal 505. The correlation instrumental memory 509 then stores the autocorrelation coefficient measured. Similarly, the remaining correlation instrumental memories 510 to 512 each measure the autocorrelation coefficient of noise from delay O to T by using the correlation coefficient between a noise-affected speech sound and noise and the correlation coefficient between noise and a noise-affected speech sound. Each memory stores the autocorrelation coefficient measured. A correlation adder/subtractor 513 performs the following calculation on the three kinds of the correlation coefficients with respect to delay from 0 to T; (correlation coefficient between a noise-affected speech sound and noise)+-(correlation coefficient between noise and a noise-affected speech sound)−(autocorrelation coefficient of noise). The adder/subtractor 513 then applies to result of the calculation as the second autocorrelation coefficient to a correlation subtractor 514. The correlation subtractor 514 is supplied with the autocorrelation coefficient of the noise-affected speech sound stored in the correlation instrument 509. The autocorrelation coefficient in this case is treated as a first correlation coefficient. Then subtracted from the first correlation coefficient is a second correlation coefficient linearly, nonlinearly or linearly in weighted manner. The result of the subtraction is applied as a third correlation coefficient to a linear predictive coefficient calculator 107. The subtracting method in nonlinear manner or in linear but weighted manner may be enumerated below:

Third correlation coefficient = first correlation coefficient-f (first correlation coefficient at delay 0, second correlation coefficient at delay 0)×second correlation coefficient Third correlation coefficient = first correlation coefficient-f ($\tau$)×second correlation coefficient Third correlation coefficient = first correlation coefficient-f (first correlation coefficient at delay 0, second correlation coefficient at delay 0,$\tau$)×second correlation coefficient where $\tau$ represents a delay ranging from 0 to T; f (first correlation coefficient at delay 0, second correlation coefficient at delay 0) is a function expressed by by m1-m2. exp (-m3×second correlation coefficient at delay 0/first correlation coefficient at delay 0); K1 to K3 are constants; f($\tau$) is a function which monotonously increases with $\tau$ and satisfies the relation $0<f(0)<f(\tau)\leqq 1$; and f(first correlation coefficient at delay 0, second correlation at delay 0,$\tau$) is a function expressed by f(first correlation coefficient at delay 0, second correlation coefficient at delay 0)×f ($\tau$). The linear predictor coefficient measuring unit 107 measures the next predictor coefficient and the normalized predictive residual power in a similar manner as described relating to FIG. 1, by using the third correlation coefficient representing the autocorrelation coefficient of a speech sound. The normalized predictive residual power is applied to the controller 301. The controller 301 judges whether the normalized predictive residual power is larger than a predetermined value, for exmaple, zero or a minute positive value. When the predictive residual power is below the predetermined value, there is a high possibility that the stability of the synthesis filter is deteriorated. Therefore, a calculation stop signal is applied to the linear predictive coefficient instrument 107. Upon receipt of the stop signal, the linear predictive coefficient instrument 107 stops its calculation. When no stop signal is applied to it, it calculates the linear predictor coefficient of the second order and the normalized predictive residual power by using the linear predictor coefficient of the first order and the normalized predictive residual power. Successively, the calculator 107 continues its calculation of the linear predictive coefficient until the controller 301 produces a calculation stop signal. As in the case of FIGS. 3 and 4, modification is possible in which the maximum predictive order N1 is previously set and the linear predictor coefficient calculator 107 is automatically stopped after the maximum predictive order N1 is calculated, regardless of the calculation stop signal, thereby eliminating unnecessary increase of the order of the linear predictive coefficient. When the calculation is stopped by the calculation stop signal after the linear predictor coefficient of the N2 order, the linear predictive coefficient of the N2 order is applied to the variable stage synthesis filter.

The controller 301 supplies a variable filter control signal to a variable synthesis filter as shown in FIG. 4. The filter coefficient of the variable synthesis filter is controlled by the linear predictive coefficient of the N2 order and the number of the filter stages is controlled by the variable stage synthesis filter control signal. The variable stage synthesis filter is excited by the filter exciting signal and produces a synthesis speech sound signal. As in the previous example, in place of the arrangement that the linear predictive coefficient instrument 107 applies the linear predictive coefficient of the N2 order and the controller 301 applies the variable stage synthesis filter control signal to the variable stage synthesis filter, the linear predictive coefficient of the N3 order can be transferred at all times, and the linear predictive coefficient from (N2)+1 to N3 order can be treated as zero. Under this condition, the use of a fixed stage synthesis filter of the N3 order can attain approximately the effect as that attained by using the variable stage synthesis filter. In this example, when the noise power of two acoustic-to-electric converters are different, the output signal of one or both of the converters may be adjusted by using an amplifier or an attenuator so that both the outputs are coincident to each other.

Figure 6:
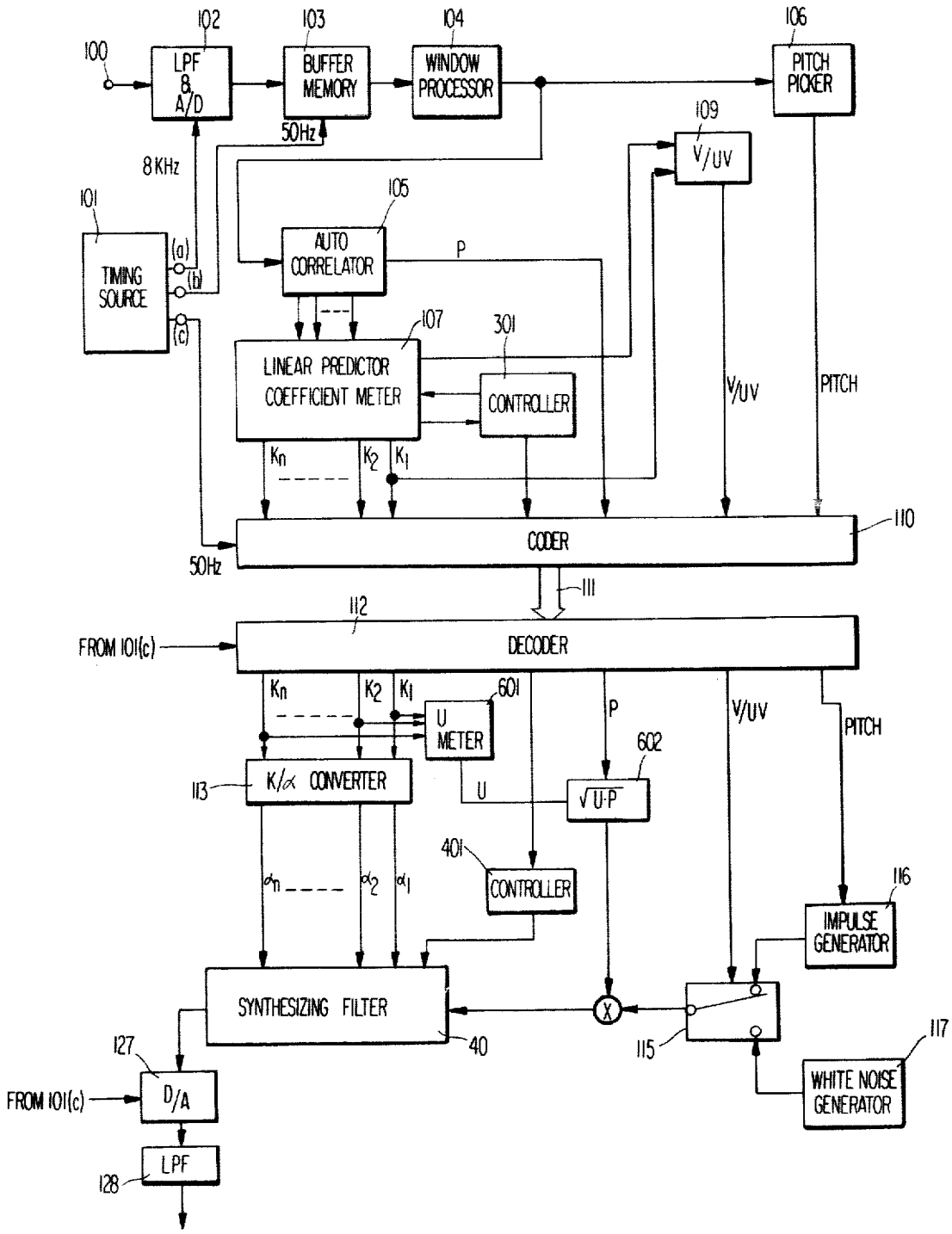
FIG. 6 shows a block diagram of a speech analysis and synthesis which is another embodiment of the invention and includes the analysis side and synthesis side.

Another embodiment of the invention which can alleviate the deterioration of the amplitude reproducibility of a synthesis speech signal due to transmission error and quantitizing error, will be described referring to FIG. 6, which shows in block form the construction of the analysis side and the synthesis side. Like reference numerals denote like structural elements in the previous embodiments.

In this example, the short time average power obtained by the correlation measuring unit 105 on the analysis side is directly applid to quantitizer 110 where is is quantized, and the quantized signal is transmitted to the synthesis side. In this case, the normalized predictive residual power obtained by the linear predictive coefficient measuring unit 107 is not transmitted. Controller 301 stops the calculation of the linear predictor coefficients of higher order when normalized predictive residual power supplied from measuring unit 107 falls below a predetermined value, and transmits a control signal representative of the order of the last linear predictive coefficient obtained before the calculation is stopped. On the other hand, the synthesis side receives and demodulates K parameters including quantization error or transmission error which are transmitted from the analysis side. The demodulated signal is applied to the normalized predictive residual power (NPRP) instrument 601. The instrument 601 measures the normalized predictive residual power in accordance with the equation (2) and applies the result of the measurement to the amplitude signal instrument 602. Thus, components 601 and 602 actually serve as part of the analysis portion of the system although located with the synthesis portion. The instrument 602 measures the exciting amplitude by using the short time average power P and normalized predictive residual power U, through the operation of /U.P. The filter stage controller 401 turns on all the switches and turns off the remaining switches included in the filter 40 as shown in FIG. 4, in response to the control signal for controlling the number of filter stages. Under such controls, the filter 40 is excited by an exciting signal. Consequently, a synthesized speech sound signal is obtained from the output of the low-pass filter 128. In case where the linear predictive coefficient demodulated are those other than the K parameters (partial autocorrelation coefficient), the normalized predictive residual power instrument 602 can obtain the normalized predictive residual power by means for converting them into the partial autocorrelation coefficients or another equivalent means. The transmission parameters such as the short time average power transmitted from the analysis side are also affected by the condition of the transmission line. The time variation of the short time average power is gentle, compared to that of the normalized predictive residual power. Accordingly, if it is smoothed in the receiving side, it has little effect on the quality of the synthesis sound. Therefore, transmission error may easily be alleviated, without being contrary to the object of the invention.

Obviously, the present invention is applicable to the linear predictor speech sound analysis and synthesis apparatus of the voice exciting method (see B. S. APAL, M. R. SCHROEGER, V. STOVR, BELL TELEPHONE LABORATORIES MURRAY HILL, N.J. 07974 "Voice Excited Predictive Cording system for Low Bit Rate Transmission of Speech" IEEE CATALOG NUMBER 75 CH0971-2SCB ICC75. JUNE 16 to 18), since the present invention is not directly related to the transmission method of the speech sound source information.

In a speech analysis and synthesis apparatus of the predictive residual wave exciting method (see, CHONG KWAN UN, AND D. THOMAS MAGILL "The Residual-Excited Linear Prediction Vocoder with Transmission Rate Below 9.6 K bits/s" IEEE Transactions on Communications, Vol. COM-23, No. 12, December 1975), the predictive residual waveform is divided by the normalized predictive residual power on the analysis side, and the amplitude variation range of the predictive residual waveform is compressed and then is transmitted to the synthesis side. On the synthesis side, the predictive residual waveform is multiplied by the normalized predictive residual power calculated from the linear predictive coefficient so that it is possible to prevent the amplitude reproducibility of the synthesized speech sound deteriorated by the transmission error of the linear predictor coefficient.

As described above, in this embodiment, the synthesizing filter is excited by the normalized predictive residual power obtained from the linear predictor coefficient which are affected by quantitizing error and transmission error so that the relation betwen the linear predictor coefficients and the normalized predictive residual power is not greatly damaged, unlike the conventional apparatus of this kind. Since there is no need for transmission of the normalized predictive residual power, the amount of information to be transmitted is reduced accordingly. When the linear predictive coefficient in the analysis frame period shorter than the analysis frame on the analysis side is interpolated on the synthesis side by using the transmitted linear interpolated by using the linear predictor coefficients, the amount of information to be transmitted can be reduced and the synthesized speech quality may be improved.

Figure 7:
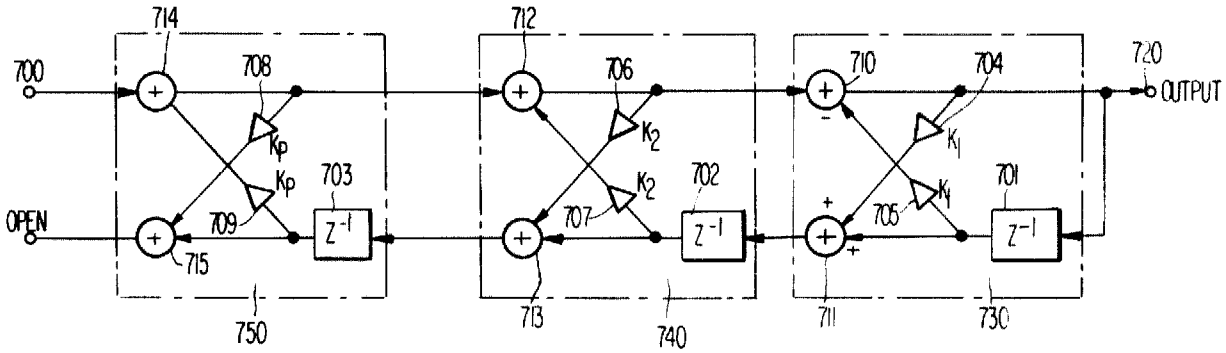
FIG. 7 shows a block diagram of another example of a speech synthesizing digital filter.

Although the speech synthesizing filter used in the above examples is constructed by a recursive filter with the coefficient of determined by $\alpha$ parameters, it may be replaced by a lattice type filter with the coefficient determined by K parameters. An example of the use of the lattice type filter is illustrated in FIG. 7. As shown, the synthesizing filter is comprised of one-sample delays 701 to 703, multipliers 704 to 709 and adders 710 to 715. A first stage filter 730 with the coefficient of K parameters K1 of the first order, a second stage filter 740 with the coefficient of K parameters K2 of the second order, and a P-th stage filter 740 with the coefficient of K parameter Kp of the Pth order are connected in cascade fashion to constitute the filter. An exciting signal is applied to the adder 714 in the final stage filter 750 and the synthesized speech sound is outputted from the input of the first stage one-sample delay 701.

What is claimed is:

1. A speech analysis and synthesis apparatus including a speech analysis part and a speech synthesis part, in which said speech analysis part comprises:

means for converting a speech sound into an electrical signal;

a filter for removing the frequency components of the electrical signal higher than a predetermined frequency;

an analog to digital converter for converting into a train of digital code words the otuput of said filter;

a memory for temporarily storing a given-length segment of the digital code word train during a predetermined frame period;

a window processor supplied with said code word read out from said memory for each predetermined frame period for window processing it and for storing the result of window processing;

autocorrelation means for determining the autocorrelation coefficient for each of said code words included in said one frame period;

calculating means for receiving the output of said autocorrelation means and calculating and providing a series of linear predictor coefficients of successively higher order representative of the spectrum information of said speech sound and a normalized predictive residual power forming speech sound source information of said speech sound;

a controller coupled to said calculating means for stopping the calculation of said linear predictor coefficients with higher order when said normalized predictive residual power falls below a predetermined value while at the same time transmitting a control signal representative of the order of the last linear predictor coefficient obtained before the calculating is stopped;

sound information means for generating sound information signals representing characteristics such as the voiced/unvoiced condition, the amplitude or the pitch of said code words;

means coupled to said calculating means, controller and sound information means for qunatizing said linear predictor coefficients, said sound information signals and said control signal for transmission; and in which said synthesis part comprises:

combining means for generating a filter input signal from said sound information signals;

a synthesizing digital filter receiving as an input said filter input signal having a coefficient determined by said linear predictor coefficients, the number of stages of said filter being variable;

means for controlling the number of stages of said synthesizing digital filter corresponding to the order of the last linear predictor coefficient obtained in the analysis part; and means for converting the output signal of said synthesizing digital filter into an analog signal.

2. A speech analysis and synthesis apparatus including a speech analysis part and a speech synthesis part in which said speech analysis part comprises:

means for converting a speech sound into an electric signal;

a filter for removing the frequency components of the electrical signal higher than a predetermined frequency;

an analog to digital converter for converting into a train of digital code words the output of said filter;

a memory for temporarily storing a given length segment of the digital code word train during a predetermined frame period;

a window processor supplied with said code word read out from said memory for each predetermined frame period for window processing it and for storing the result of window processing;

autocorrelation means for determining the autocorrelation coefficient for each of said code words included in said one frame period;

calculating means for receiving the output of said autocorrelation means and for calculating and providing a series of linear predictor coefficients of successively higher order representative of the spectrum information of said speech sound and a normalized predictive residual power forming speech sound source information of said speech sound;

control means coupled to said calculating means for producing a control signal representative of zero for the value of any linear predictor coefficients with higher order than the last calculated linear predictor coefficient when said normalized predictive residual power falls below a predetermined value;

sound information means for generating sound information signals representing characteristics such as the voiced/unvoiced condition, the amplitude or the pitch of said code words;

means coupled to said calculating means, control means and sound information means for quantizing said linear predictor coefficients, said sound information signals and said control signal for transmission; and in which said synthesis part comprises:

combining means for generating a filter input signal from said sound information signals;

a synthesis digital filter receiving said filter input signal as its input and having a filter coefficient determined by said linear predictor coefficients, said synthesizing digital filter comprising a plurality of stages of successively higher order corresponding to the orders of said linear predictor coefficients and each said filter stage receiving as its filter stage coefficient the linear predictor coefficient having the same order, whereby filter stages of order higher than the order of said last calculated linear predictor coefficient receive a zero value filter stage coefficient; and means for converting the output signal of said synthesizing digital filter into an analog signal.

3. A speech analysis and synthesis apparatus according to claim 1 or 2, in which the highest order of linear predictor coefficient to be obtained is predetermined.

4. A speech analysis and synthesis apparatus including a speech analysis part and a speech synthesis part in which said speech analysis part comprises:

a first converting means for converting a noise-affected speech sound signal into an electrical signal, sampling with given sampling pulses the electrical signal for conversion into a train of first digital code words, and subsequently window processing these first digital code words for every predetermined frame period;

a second converting means for generating an electrical signal representative of noise affecting said speech sound signal, sampling the noise-representing signal for conversion into a train of second digital code words, and subsequently window processing these second digital code words for every predetermined frame period;

a first autocorrelation measuring means (509) for producing as a first autocorrelation coefficient the autocorrelation coefficient with respect to the output signal of said first converting means;

a second autocorrelation measuring means (512) for producing a second autocorrelation coefficient with respect to the output signal of said second converting means;

a correlation means (510,511) for producing a pair of correlation coefficients with respect to the output of said first and second means;

a correlation subtractor (513,514) for subtracting the output of said correlation means from that of said first and second autocorrelation means;

calculating means responsive to outputs from said correlation subtractor for calculating and providing a series of linear predictor coefficients of successively higher order representative of the spectrum information of said speech sound and a normalized predictive residual power;

a controller coupled to said calculating means for stopping the calculation of any linear predictor coefficient of higher order in response to said normalized predictive residual power falling below a predetermined value while transmitting at the same time a control signal representative of the order of the last linear predictor coefficient obtained before calculation is stopped;

sound information means for generating sound information signals representing characteristics such as the voiced/unvoiced condition, the amplitude or the pitch of said code words;

means coupled to said calculating means, said controller and said sound information means for quantizing said linear predictor coefficients and said sound information signals and said control signal for transmission; and in which said synthesis part comprises:

combining means for generating a filter input signal from said sound information signals;

a synthesizing digital filter receiving said filter input signal as its input and having a filter coefficient determined by said linear predictor coefficients, the number of stages of said filter being variable;

means for controlling the number of stages of said synthesizing digital filter corresponding to the order of said last calculated liner predictor coefficient obtained in the analysis part; and means for converting the ouptut signal of said synthesizing digital filter into an analog signal.

5. A speech analysis and synthesis apparatus including a speech analysis part and a speech synthesis part in which said speech analysis part comprises:

a first converting means for converting a noise-affected speech sound signal into an electrical signal, sampling with given sampling pulses the electrical signal for conversion into a train of first digital code words, and subsequently window processing these first digital code words for every predetermined frame period;

a second converting means for generating an electrical signal representative of noise-affecting said speech sound signal, sampling the noise-representing signal for conversion into a train of second digital code words, and subsequently window processing these second digital code words for every predetermined frame period;

a first autocorrelation measuring means coupled to said first converting means for producing as a first autocorrelation coefficient the autocorrelation coefficient with respect to the output of said first converting means;

a second autocorrelation measuring means coupled to said second converting means for producing a second autocorrelation coefficient with respect to the output signal of said second converting means;

a correlation means for producing a pair of correlation coefficients with respect to the output of said first and second converting means;

a correlation subtractor for subtracting the outputs of said correlation means from that of said first and second autocorrelation means;

calculating means responsive to outputs from said correlation subtractor for calculating and providing a series of linear predictor coefficients of successively higher order representative of the spectrum information of said speech sound and a normalized predictive residual power;

means for producing as zero the value of any linear predictor coefficient with higher order when said normalized predictive residual power falls below a predetermined value;

sound information means for generating sound information signals representing characteristics such as the voiced/unvoiced condition, the amplitude or the pitch of said code words;

means for receiving and quantizing for transmission said linear predictor coefficients and said sound information signals; and in which said synthesis part comprises:

combining means for generating a filter input signal from said sound information signals;

a synthesizing digital filter receiving said filter input signal as its input and comprising a plurality of stages of successively higher order corresponding to the orders of said linear predictor coefficients and each said filter stage receiving as its filter stage coefficient the linear predictor coefficient having the same order, whereby filter stages of order higher than the order of said last calculated linear predictor coefficient receive zero value filter stage coefficients; and means for converting the output signal of said synthesizing digital filter into an analog signal.

6. A speech analysis and synthesis apparatus according to claim 4 or 5, further comprising means for adjusting the output signals from said first and second converting means so that the noise component outputs from said first and second converting means are equal to each other.

7. A speech analysis and synthesis apparatus according to claim 4 or 5 wherein said correlation subtractor is a subtractor for nonlinearly subtracting.

8. A speech analysis and synthesis apparatus according to claim 1, 2, 4, or 5 further comprising in the synthesis part means for calculating a normalized predictive residual power from said linear predictor coefficients, said normalized predictive residual power being part of the input signal to said synthesizing digital filter.

9. A speech analysis and synthesis apparatus according to claim 7 in which said synthesizing digital filter is a recursive filter having a filter coefficient which is determined by a plurality of filter stage coefficients in a linear predictive method and in which the data value at any point in time is linearly predictable from past data values.

10. A speech analysis and synthesis apparatus according to claim 1, 2, 4, or 5, in which said synthesizing digital filter is of a lattice type having its filter coefficient determined by a partial autocorrelation coefficient i.e., K parameter.

* * * * *